US011299944B2

(12) United States Patent
Hered

(10) Patent No.: US 11,299,944 B2
(45) Date of Patent: Apr. 12, 2022

(54) BYPASS TOOL FOR FLUID FLOW REGULATION

(71) Applicant: William Hered, Houston, TX (US)

(72) Inventor: William Hered, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 5 days.

(21) Appl. No.: 16/191,817

(22) Filed: Nov. 15, 2018

(65) Prior Publication Data

US 2020/0157897 A1 May 21, 2020

(51) Int. Cl.
*E21B 21/10* (2006.01)
*E21B 34/12* (2006.01)

(52) U.S. Cl.
CPC ..... *E21B 21/103* (2013.01); *E21B 34/12* (2013.01)

(58) Field of Classification Search
CPC ..... E21B 21/103; E21B 21/08; E21B 21/10
See application file for complete search history.

(56) References Cited

U.S. PATENT DOCUMENTS

| | | | | |
|---|---|---|---|---|
| 2,833,517 | A * | 5/1958 | Bobo | E21B 21/103 175/69 |
| 5,407,020 | A * | 4/1995 | Beavers | E21B 21/10 175/317 |
| 5,421,420 | A * | 6/1995 | Malone | E21B 7/06 175/61 |
| 6,263,969 | B1 | 7/2001 | Stoesz et al. | |
| 6,520,271 | B1 * | 2/2003 | Martini | E21B 4/02 175/107 |
| 9,328,576 | B2 | 5/2016 | Cramer et al. | |
| 10,302,083 | B2 * | 5/2019 | Downton | E21B 4/02 |
| 2004/0027917 | A1 | 2/2004 | Winnacker | |
| 2004/0129423 | A1 | 7/2004 | Eddison | |
| 2008/0000633 | A1 | 1/2008 | Xu et al. | |
| 2008/0011517 | A1 * | 1/2008 | Lyon | E21B 21/16 175/231 |

(Continued)

FOREIGN PATENT DOCUMENTS

CN 204827261 U 12/2015

OTHER PUBLICATIONS

International Search Report for International Application No. PCT/US2019/059969; International Filing Date: Nov. 3, 2019, dated Apr. 8, 2020, 3 pages.

(Continued)

*Primary Examiner* — Kipp C Wallace
(74) *Attorney, Agent, or Firm* — Cantor Colburn LLP

(57) ABSTRACT

An embodiment of a fluid bypass apparatus includes an axially elongated body configured to be deployed in a borehole in an earth formation, the body including a pilot conduit that allows fluid to flow through the body and a bypass conduit extending from the pilot conduit to an exterior of the body and defining a fluid flow path from the primary conduit to the exterior of the body, The apparatus also includes a modular valve insert housed within the bypass conduit, the valve insert being removable and replaceable, the modular valve insert configured to obstruct the fluid flow path and configured to automatically open in response to a pressure or flow rate through the primary conduit meeting or exceeding a selected threshold pressure or flow rate.

15 Claims, 4 Drawing Sheets

(56) References Cited

U.S. PATENT DOCUMENTS

| | | | | |
|---|---|---|---|---|
| 2009/0095463 | A1* | 4/2009 | Swan | E21B 21/103 166/53 |
| 2009/0095528 | A1* | 4/2009 | Hay | F04C 2/1073 175/26 |
| 2012/0261127 | A1* | 10/2012 | Zhou | E21B 33/146 166/289 |
| 2013/0008647 | A1* | 1/2013 | Dirksen | E21B 47/06 166/250.01 |
| 2015/0136492 | A1* | 5/2015 | Speer | E21B 21/12 175/70 |
| 2015/0292280 | A1* | 10/2015 | Lewis | E21B 21/103 175/25 |
| 2016/0002993 | A1* | 1/2016 | MacGregor | E21B 21/103 175/218 |
| 2016/0017690 | A1 | 1/2016 | Baudoin | |
| 2018/0171752 | A1* | 6/2018 | Cherny | E21B 21/103 |
| 2020/0024910 | A1* | 1/2020 | Breivik | E21B 17/18 |

OTHER PUBLICATIONS

Written Opinion for International Application No. PCT/US2019/059969; International Filing Date: Nov. 6, 2019, dated Apr. 8, 2020, 5 pages.

* cited by examiner

BYPASS TOOL FOR FLUID FLOW REGULATION

BACKGROUND

In the resource recovery industry, bypass tools or "subs" are used to regulate flow properties of fluids that are circulated in or otherwise flow through a borehole. For example, bypass tools can be incorporated in borehole strings for use in drilling, milling, stimulation and production operations. Due to high temperatures and pressures in downhole environments, components of bypass tools, such as springs and valves, can be damaged or compromised due to erosion, vibration and other conditions.

SUMMARY

An embodiment of a fluid bypass apparatus includes an axially elongated body configured to be deployed in a borehole in an earth formation, the body including a pilot conduit that allows fluid to flow through the body and a bypass conduit extending from the pilot conduit to an exterior of the body and defining a fluid flow path from the primary conduit to the exterior of the body, The apparatus also includes a modular valve insert housed within the bypass conduit, the valve insert being removable and replaceable, the modular valve insert configured to obstruct the fluid flow path and configured to automatically open in response to a pressure or flow rate through the primary conduit meeting or exceeding a selected threshold pressure or flow rate.

An embodiment of a method of controlling fluid flow in a borehole includes deploying a borehole string in the borehole, the borehole string including a bypass apparatus having an axially elongated body, the body including a pilot conduit that allows fluid to flow through the body, and a bypass conduit extending from the pilot conduit to an exterior of the body and defining a fluid flow path from the primary conduit to an exterior of the body. The bypass apparatus includes a modular valve insert housed within the bypass conduit, the modular valve insert being removable and replaceable, the modular valve insert configured to be closed to obstruct the fluid flow path when a pressure or flow rate through the pilot conduit is below a threshold pressure or flow rate value. The method also includes, based on the pressure or flow rate meeting or exceeding the threshold pressure or flow rate, automatically opening the valve insert and permitting fluid to flow from the pilot conduit to the exterior to reduce the pressure or flow rate.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatuses, systems and methods are presented herein by way of exemplification and not limitation with reference to the Figures.

Figure 1:
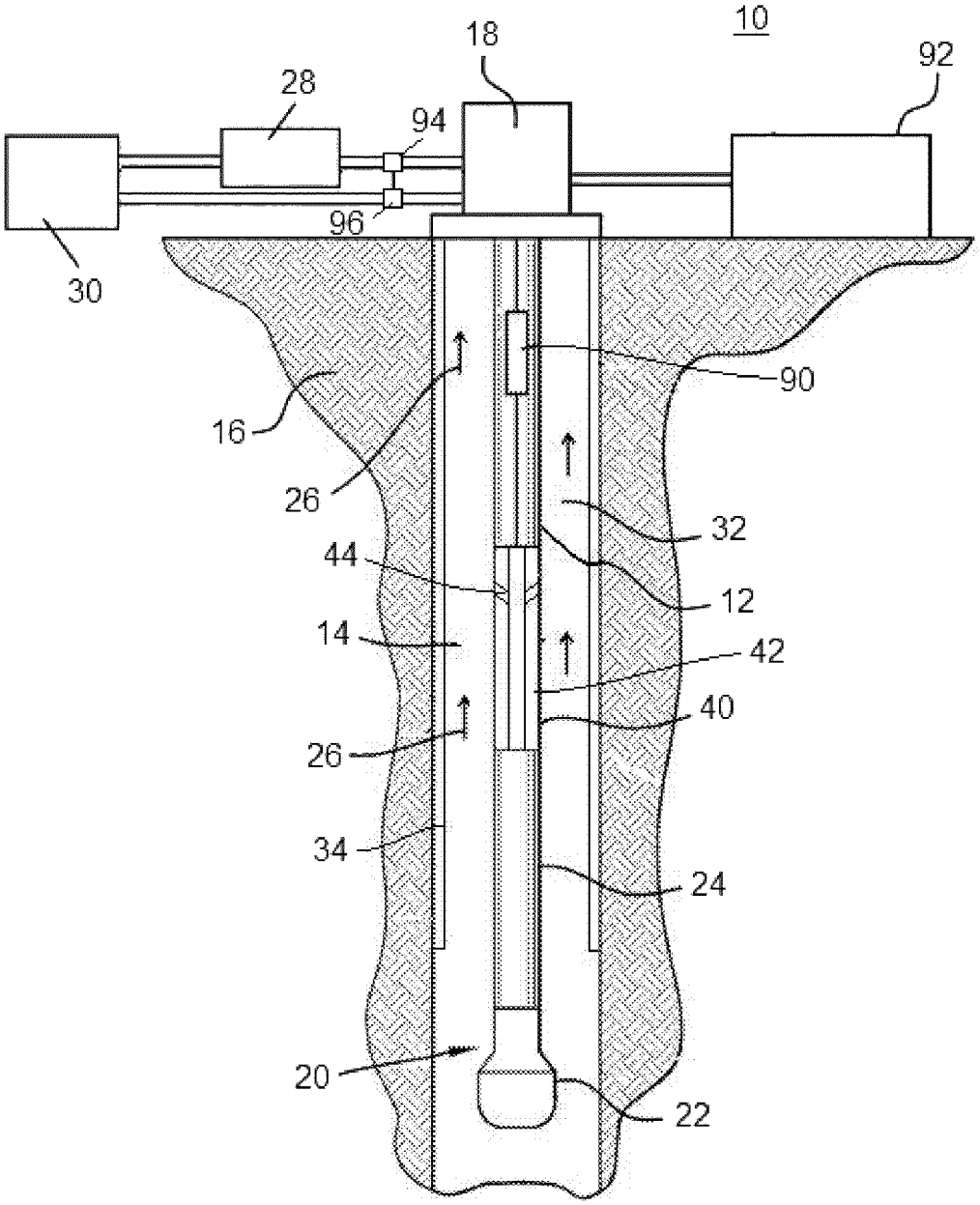
FIG. 1 depicts an embodiment of a drilling, resource production and/or measurement system that includes a drilling and/or milling assembly and a bypass tool.

Referring to FIG. 1, an embodiment of a well drilling, milling and/or production system 10 includes a borehole string 12 that is shown disposed in a well or borehole 14 that penetrates at least one earth formation 16 during a drilling or other downhole operation. As described herein, "borehole" or "wellbore" refers to a hole that makes up all or part of a drilled well. It is noted that the borehole 14 may include vertical, deviated and/or horizontal sections, and may follow any suitable or desired path. As described herein, "formations" refer to the various features and materials that may be encountered in a subsurface environment and surround the borehole 14.

A surface structure or surface equipment 18 includes or is connected to various components such as a wellhead, derrick and/or rotary table for supporting the borehole string 12, rotating the borehole string 12 and lowering string sections or other downhole components. In one embodiment, the borehole string 12 is a drill string including one or more drill pipe sections that extend downward into the borehole 14, and is connected to a bottomhole assembly (BHA) 20. The BHA 20 includes a bit 22 that can be configured for various purposes. For example, the bit 22 can be a drill bit (e.g., a roller cone bit) for drilling the borehole (e.g., a primary borehole or sidetrack) or a milling bit for purposes such as junk milling, plug milling or casing removal.

The bit 22 can be driven from the surface and/or downhole. In one embodiment, the bit 22 is driven by a downhole motor or mud motor 24. The mud motor 24 includes a stator and a rotor that is rotated by fluid traveling therethrough. Flow properties of fluid circulated through the mud motor, such as pressure and flow rate, can be controlled to control the speed of the mud motor 24. Although the bit 22 is shown in FIG. 1 as being rotated by the mud motor, the bit 22 may instead or in addition be rotated by a surface rotary device.

The surface equipment 18 includes components to facilitate circulating fluid 26 such as drilling mud through the string 12 and the mud motor 24. For example, a pumping device 28 is located at the surface to circulate fluid 26 from a mud pit or other fluid source 30 into the borehole 14. Fluid 26 is pumped through a conduit such an interior bore of the borehole string 12, flows through the mud motor 24 and exits the borehole string 12 at or near the drill bit 22. The fluid 26 then travels upward from the drill bit 22 through an annulus 32 of the borehole 14 (e.g., between the borehole string 12 and the borehole wall) and returns to the surface. If the borehole 14 includes a cased section, the annulus 32 is defined by the exterior of the borehole string 12 and a casing 34

Although the system 10 is shown as including a drill string, it is not so limited and may have any configuration suitable for performing an energy industry operation that includes injecting or circulating fluid in the borehole 14. For example, the system 10 may be configured as a stimulation system, such as a hydraulic fracturing and/or acidizing system.

The system 10 also includes a bypass apparatus or bypass tool 40 (also referred to as a bypass sub) that is configured to control properties such as fluid pressure and flow rate through the mud motor 24 and/or other downhole components. The bypass tool 40 includes a body 42 and one or more valve inserts 44. The valve inserts 44 each include a valve assembly (also referred to simply as a valve) that is configured to permit fluid 26 to flow through a radially extending conduit in the body 42 to the annulus 32 if the pressure or flow rate of fluid flowing through the body 42 from the surface is greater than or equal to a selected pressure or flow rate. In this way, the bypass tool 40 maintains the fluid flow rate and pressure into the mud motor 24 at or below a selected value or threshold to avoid wearing or damaging the mud motor 24 during a downhole operation such as a drilling, stimulation, or milling operation.

Figure 2:
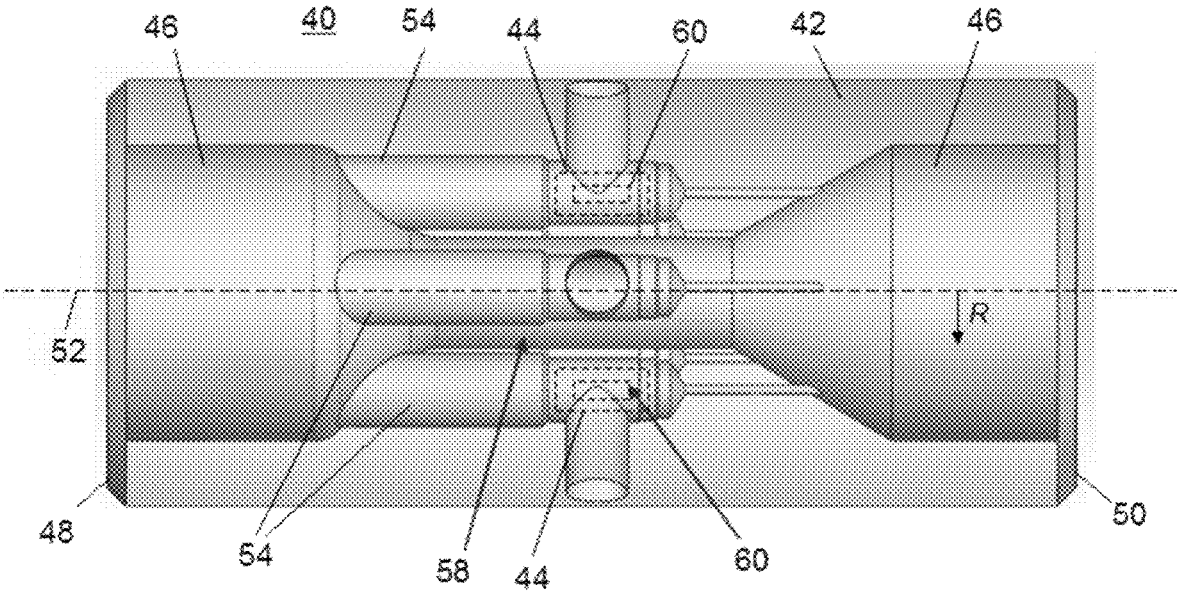
FIG. 2 depicts an embodiment of the bypass tool of FIG. 1.

Referring to FIG. 2, in one embodiment, the body 42 includes a primary bore or conduit 46, also referred to as a pilot conduit 46, which extends axially from a first end 48 to a second end 50 of the body 42. It is noted that an "axially extending" component refers to a component that extends in a direction that is partially or at least substantially parallel to a central axis 52 of the body 42.

The body 42 also includes one or more secondary conduits 54, also referred to as bypass conduits 54, each of which is configured to house a valve insert 44. Each bypass conduit 54 extends radially from the pilot conduit 46 to an exterior of the body 42. In one embodiment, each bypass conduit 54 is defined by a bore formed in a wall of the body 42 between the pilot conduit 46 and the exterior of the body 42.

When the bypass tool 40 is disposed in the borehole 14 and a valve insert 44 opens, the corresponding bypass conduit 54 provides a fluid path from the pilot conduit 46 to the annulus 32. It is noted that a "radially extending" component refers to a component that extends in a radial direction R that is perpendicular to the central axis 52, or at least partially extends in the radial direction R.

The pilot conduit 46 may be centrally located between the walls of the body 42 (e.g., having a central axis that at least substantially corresponds to the central axis 52 of the body 42) or offset from the center. The pilot conduit 46 provides a fluid path from the borehole string 12 upstream from the bypass tool 40 to the mud motor 24 or other component downstream from the bypass tool 40. In one embodiment, the pilot conduit 46 includes a section of reduced diameter that acts as a restriction 58.

In one embodiment, the body 42 itself can be constructed with no moving parts, and may be formed of a single piece of steel, aluminum or other material, or formed by multiple sections that are welded or otherwise permanently connected to form an integral or unitary body. For example, the body 42 is an integral body including a bore forming the pilot conduit 46, and including one or more bores in the walls of the body 42 that extend from the pilot conduit and form one or more bypass conduits 54.

In the embodiment shown in FIG. 2, the body 42 includes a plurality of bypass conduits 54, each of which is configured to receive and retain a valve insert 44. For example, each valve insert 44 includes a housing that houses the entirety of or part of a valve assembly that is removably or permanently disposed in the housing. Optionally, a flow conduit such as a cylindrical tubular component is attached to or part of the housing. The housing and/or flow conduit includes a connection mechanism (e.g., threads) configured to engage a corresponding connection mechanism at the body 42.

In the embodiment of FIG. 2, each bypass conduit 54 extends generally axially from the section of the central bore upstream from the restriction 58, and forms a separate conduit from the restriction 58. Each bypass conduit 54 also has a radially extending section that extends to the exterior of the body 42. Each valve insert 44 can be removably inserted into a respective bypass conduit 54 (e.g., inserted through the pilot bore 46 and into an axially extending section of the bypass conduit 54), and temporarily secured by any suitable mechanism, such as a threaded connection or by bolts or other fasteners. Check valves can be added to the bypass conduits 54 and/or the pilot conduit 46 to prevent reverse flow of fluid.

Figure 3:
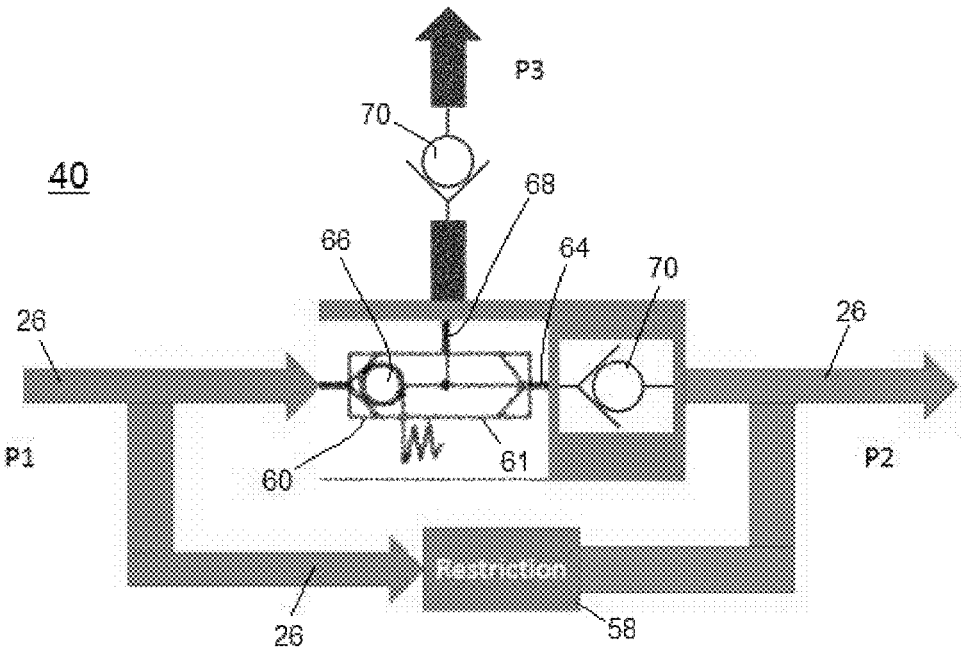
FIG. 3 is a diagram illustrating fluid flow through the bypass tool of FIG. 2.

FIG. 3 is a diagram showing fluid flow through the bypass tool 40 and an example of a valve assembly. In this example, the valve assembly is a shuttle valve assembly 60. The shuttle valve assembly 60 includes a housing 61 having two inlets 62 and 64 and a free moving shuttle 66 that moves between the two inlets 64 and 66. When the differential pressure in the shuttle valve assembly 60 reaches a selected cracking pressure, the shuttle 66 moves to the second inlet 64, permitting fluid to flow from the first inlet 62 to an outlet 68 and to the annulus 32 (e.g., through the radially extending section of the bypass conduit 54 of FIG. 2). "Cracking pressure" generally refers to a pressure applied by fluid to the valve assembly, which is high enough to apply a force that opens the valve assembly.

Flow of fluid through the bypass tool 40 is shown schematically in FIG. 3. Drilling mud or other fluid 26 enters the body 42 of the bypass tool 40 at a first pressure P1. The shuttle valve assembly 60 has a set cracking pressure or flow rate (e.g., about 2 bbl/min or 4 bbl/min) that is selected so that a pressure P2 of the fluid 26 exiting the body 42 is equal to or less than a selected threshold pressure or flow rate. For example, the shuttle valves assemblies 60 each have a cracking pressure selected so that the pressure differential between fluid entering and exiting (differential=P1−P2) the bypass tool 40 is maintained at a constant or substantially constant amount.

For example, when the differential pressure in the pilot conduit 46 meets or exceeds the cracking pressure of a shuttle valve assembly 60, the shuttle valve assembly 60 opens, thereby permitting some of the fluid 26 to be diverted away from the borehole string 12, e.g., into an annulus between the tool 40 and a casing or a formation. In FIG. 3, the pressure of diverted fluid is P3. In one embodiment, P1 is greater than P2, and P2 is greater than P3, i.e., P1>P2>P3. In one embodiment, fluid 26 diverted from the tool 40 is not allowed to enter the tool or string, but is instead circulated uphole through the annulus 32.

As noted above, one or more check valves can be disposed in the tool 40, the body 42 and/or the bypass conduits 54. For example, as shown in FIG. 3, a check valve 70 can be positioned in each bypass conduit 54 and/or in the pilot bore 46 to prevent fluid from flowing in reverse.

The valve insert 44 or combination of valve inserts 44 provides a configurable flow regulation capability. For example, by spanning the restriction 58 with a valve assembly such as the shuttle valve assembly 60 with a set cracking pressure, the bypass tool 40 becomes configured to bypass fluid when a pressure differential across the restriction 58 exceeds the cracking pressure of a valve assembly. Since the pressure differential across the restriction 58 is determined by the flow of fluid through the bypass tool 40, the bypass tool 40 gains closed-loop feedback on the flow.

It is noted that any number of valve assemblies may be incorporated into the bypass tool 40. For example, multiple valve assemblies and bypass conduits 54 can be positioned in parallel to control the amount of fluid that can be bypassed, where additional valve assemblies increase the amount of fluid that can be bypassed.

Figure 4:
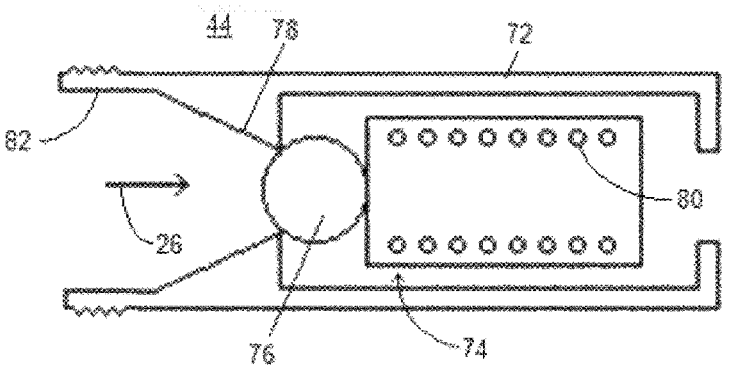
FIG. 4 depicts an embodiment of a valve insert configured to be inserted into a bypass tool.

FIG. 4 illustrates an example of a valve insert 44. The valve insert 44 includes a housing 72 that forms an opening to a valve assembly 74, which houses a ball or other moveable component 76 and a valve seat 78. A biasing mechanism such as a spring 80 is configured to compress and allow the moveable component 76 to move away from the valve seat 78 when the differential pressure in the housing 72 meets or exceeds the cracking pressure.

The housing 72 may be a cylindrical body or a body having a different shape, and houses the components of the valve assembly 74. The valve insert 44 also includes a connection mechanism 82 such as a set of internal or external threads that allows the valve insert 44 to be removably secured within a bypass conduit 54. It is noted that the housing 72 may have any suitable length or shape and may include additional components as desired. For example, an additional conduit can be removably connected (e.g., via threading) or permanently attached (e.g., via welding) to the housing 72. The housing 72 permits the valve insert 44 to be connected, removed and replaced without having to engage or affect any of the components of the valve assembly 74.

Figure 5:
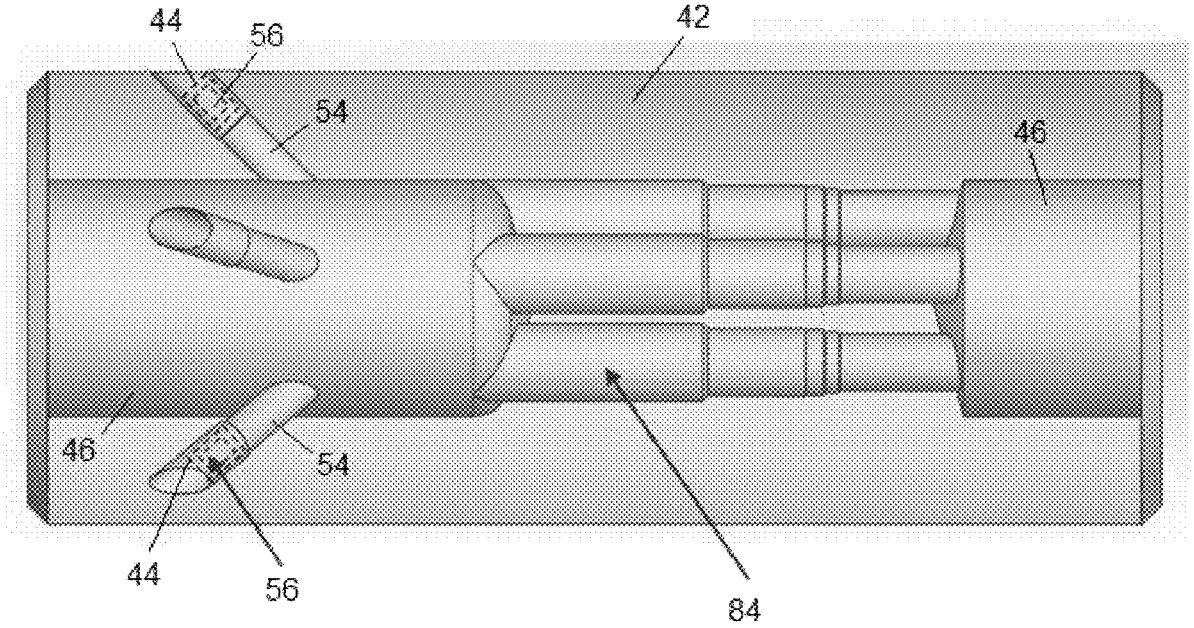
FIG. 5 depicts an embodiment of the bypass tool of FIG. 1.

FIG. 5 shows another embodiment of the bypass tool 40. In this embodiment, the pilot conduit 46 has a section formed by one or more pressure compensated flow regulators 84. The number of flow regulators 84 is selected to create the desired downhole flow. In this embodiment, the valve inserts 44 include one or more pressure relief valves 56 that are arranged uphole of the flow regulators 84 to divert excess flow to the annulus 32.

Figure 6:
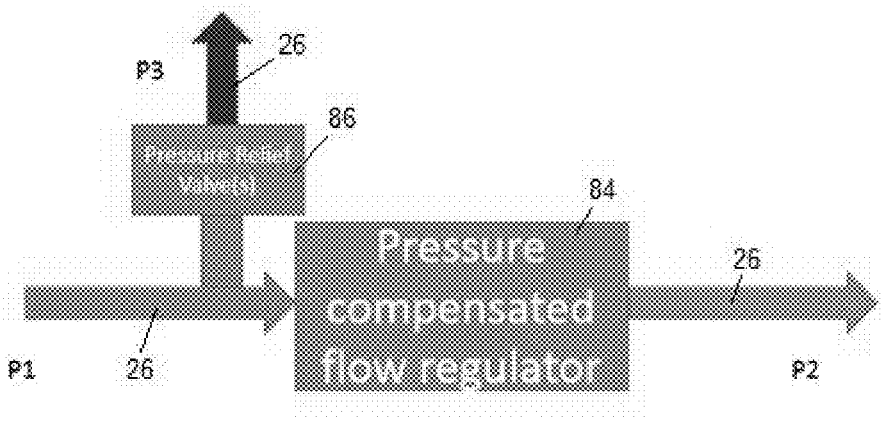
FIG. 6 is a diagram illustrating fluid flow through the bypass tool of FIG. 5.

Flow of fluid through the bypass tool 40 in this embodiment is shown in FIG. 6, which shows schematically a flow regulator 84 and one or more pressure relief valves 86. An example of a suitable pressure relief valve 86 is the valve assembly 74. Drilling mud or other fluid 26 enters the body 42 of the bypass tool 40 at a first pressure P1. Fluid flows through the flow regulators 84, which restrict the pressure to a selected pressure P2, e.g., a pressure suitable for the mud motor 24 (e.g., ½ to 4 barrels per min or bbl/min). Fluid thereafter flows from the pilot conduit 46 to the mud motor 24 or other downhole component. The pressure relief valves 86 have one or more cracking pressures or flow rates that are selected so that the pressure P2 of the fluid exiting the body 42 and entering the mud motor 24 is equal to or less than a selected pressure. For example, the pressure relief valves 86 have a cracking pressure selected so that the pressure differential between fluid entering and exiting (differential=P1−P2) is maintained at a constant or substantially constant amount.

For example, when the differential pressure in the pilot conduit 46 (differential=P2−P1) meets or exceeds the cracking pressure, at least one of the pressure relief valves 86 opens, thereby permitting some of the fluid 26 to be diverted away from the borehole string, e.g., in an annulus between the tool 40 or drill string and casing or the formation. In FIG. 6, the pressure of diverted fluid is P3. In one embodiment, P1 is greater than P2, and P2 is greater than P3, i.e., P1>P2>P3. In this embodiment, fluid 26 diverted from the tool 40 is not allowed to enter the tool 40 or drill string, but is instead circulated uphole through the annulus.

The bypass conduits 54 in the body 42 may each house the same type of valve or valve configured to have the same cracking pressure, or different combinations of valves and/or cracking pressures may be used to further regulate fluid. For example, the valve inserts 44 can be set with differing cracking pressures to achieve a more stable flow rate to downstream components. For example, at 4 bbl/min from the surface, one valve can be configured to open, and at 5 bbl/min, two valves can be configured to open.

It is noted that the valve assemblies described herein are passive valve assemblies that automatically open in response to fluid pressure meeting or exceeding some threshold vale. The valve assemblies, however, are not so limited. For example, one or more valve assemblies may be an active valve assembly that is controlled using a controller (e.g., at the surface). The controller is configured to send a signal downhole to an active valve assembly to cause the valve assembly to open. The signal may be generated by a human operator using the controller and/or may be automatically generated when measured fluid pressure or flow rate reaches a selected value.

Referring again to FIG. 1, in one embodiment, one or more downhole components and/or one or more surface components may be in communication with and/or controlled by a processor such as a downhole processor 90 or a surface processing unit 92. In one embodiment, the surface processing unit 92 is configured as a surface control unit which controls various parameters such as rotary speed, weight-on-bit, fluid flow parameters (e.g., pressure and flow rate) and others. Surface and/or downhole sensors or measurement devices may be included in the system 10 for measuring and monitoring aspects of an operation, fluid properties, component characteristics and others.

The surface processing unit 92 and/or the downhole processor 90 may include or may be connected to various sensors for measuring fluid flow characteristics. For example, the system 10 includes fluid pressure and/or flow rate sensors 94 and 96 for measuring fluid flow into and out of the borehole 12, respectively. Fluid flow characteristics may also be measured downhole, e.g., via fluid flow rate and/or pressure sensors in the tool(s) 30.

The drill bit 22, mud motor 24, bypass tool 40 and/or other components may be included in or embodied as a BHA, drill string component or other suitable carrier. A "carrier" as described herein means any device, device component, combination of devices, media and/or member that may be used to convey, house, support or otherwise facilitate the use of another device, device component, combination of devices, media and/or member. Exemplary non-limiting carriers include drill strings of the coiled tubing type, of the jointed pipe type and any combination or portion thereof. Other carrier examples include casing pipes, wirelines, wireline sondes, slickline sondes, drop shots, downhole subs, bottom-hole assemblies, and drill strings.

Figure 7:
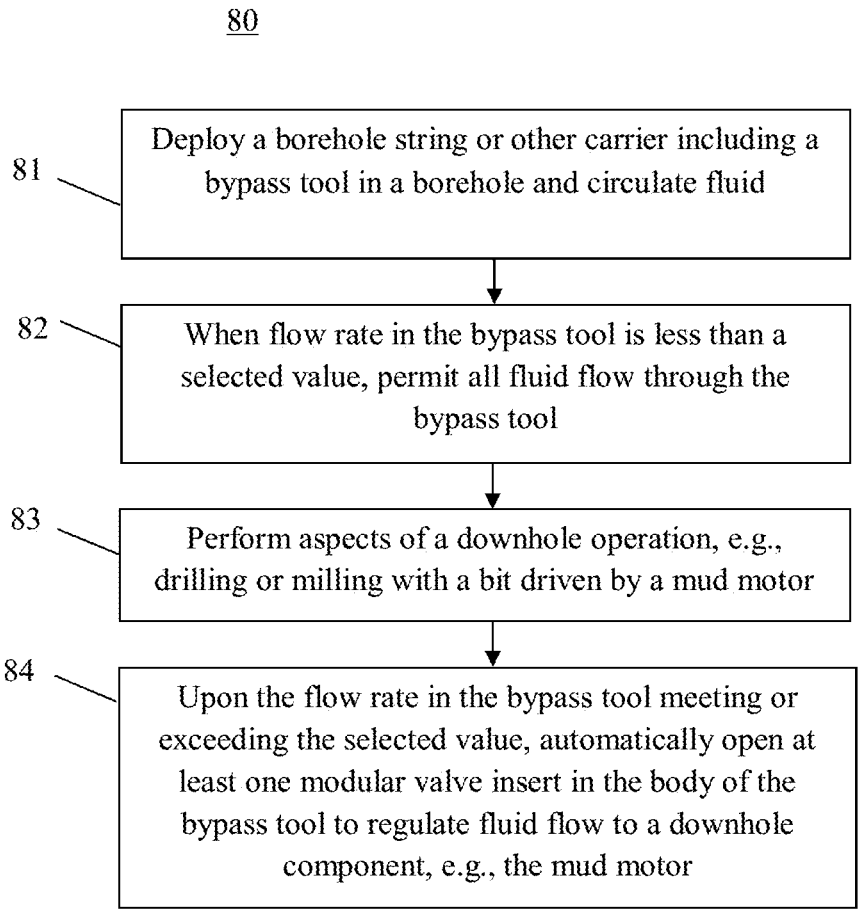
FIG. 7 is a flow chart that depicts an embodiment of a method of regulating fluid flow in a borehole string and/or borehole.

FIG. 7 illustrates a method 100 of performing a downhole operation and regulating fluid flow into a downhole component in a borehole and/or incorporated in a borehole string. The method 100 may be performed in conjunction with the system 10, but is not limited thereto. Aspects of the method 100 may be performed by a processor such as the surface processing unit 92, either automatically or through input by a human operator.

The method 100 includes one or more of stages 101-104 described herein, at least portions of which may be performed by a processor, such as the surface processing unit 92. In one embodiment, the method 100 includes the execution of all of stages 101-104 in the order described. However, certain stages 101-104 may be omitted, stages may be added, or the order of the stages changed.

In the first stage 101, a drill string, production string 12 or other carrier is deployed into a borehole 14. Drilling is performed by rotating a drill bit 22 and circulating drilling fluid 26 (e.g., drilling mud) into the borehole 14. For example, drilling fluid 26 is pumped into the borehole 14 from a mud pit or other fluid source 30 via, e.g., the pumping device 28.

As described herein, "drilling" refer to any operation that creates a borehole, extends an existing borehole, or otherwise modifies a borehole (e.g., increases borehole size). Drilling can include normal "on bottom, making hole" drilling, but can also include other operations that involve circulating fluid downhole. Examples of operations that may be considered drilling operations include wiper trips and reaming Such drilling operations may include the use of a drilling-like downhole component (e.g., BHA), such as a drilling assembly, a measurement while drilling (MWD) component, a logging while drilling (LWD) component, a measurement after drilling (MAD) component, a milling component, and a component or assembly for reaming a hole or opening it up to a larger hole size. Although the method is described as being in conjunction with a drilling operation, the method may be used with other types of operations that require flow regulation, such as stimulation (e.g., hydraulic fracturing) and production or completions-related operations.

Flow properties such as fluid pressure and flow rate are controlled at the surface via, e.g., the pumping device 28 and the surface processing unit 92. The flow rate and fluid pressure that is output from the bypass tool 40 should be maintained at a selected pressure or at least within a selected pressure range (e.g., at or below some threshold).

The selected flow rate is based on the characteristics of the downhole component that is downstream of the bypass tool 40. If the downhole component is the mud motor 24, then the pressure and flow rate should be maintained to not exceed the selected pressure. The selected flow rate may be a threshold above which the flow of fluid could cause damage to the mud motor 24 or cause sub-optimal performance. For example, the mud motor 24 has a maximum pressure differential and flow rate.

In the second stage 102, as fluid is circulated through the borehole string 12, the bypass tool 40 permits the flow of all fluid flowing through the pilot conduit 46 if the differential pressure in the tool 40 and a corresponding pressure differential in a valve assembly in a valve insert is below a cracking pressure of the valve assembly.

In the third stage 103, aspects of a downhole operation are performed. The operation may be a drilling operation and/or a production operation for producing energy resources (e.g., oil and/or gas) from a formation or subterranean region. For example, fluid pressure drives the mud motor 24 to turn a drill bit or milling bit 22. The bit 22 may be used to drill the borehole 14, extend the borehole 14, create additional boreholes (e.g., sidetracking) and/or mill downhole objects or components, such as casing, junk or a cement plug.

In the fourth stage 104, when fluid pressure in the bypass tool 40 exceeds the cracking pressure of a valve insert 44, the valve insert 44 is automatically opened and allows fluid 26 to be diverted to the annulus 32 to reduce the pressure of fluid entering the mud motor 24.

As noted above, in one embodiment, multiple valve inserts 44 having at least two different cracking pressures are disposed in the bypass tool 40. In such an embodiment, a first valve assembly opens when the differential pressure in the pilot conduit 46 exceeds the lowest cracking pressure. If the differential pressure continues to increase and exceeds a higher cracking pressure, at least another valve assembly opens.

The method 100 may include configuring the bypass tool 40 prior to deploying the borehole string 12, reconfiguring the bypass tool 40 during the operation and/or reconfiguring the bypass tool 40 after the operation. For example, prior to deploying the borehole string 12, the bypass tool 40 is set up by inserting one or more valve inserts 44 into a respective bypass conduit 54, e.g., by screwing the valve insert 44 into a threaded portion of the bypass conduit 54. In another example, if there is damage to the bypass tool 40 or if the bypass tool 40 needs to be reconfigured, the bypass tool 40 is retrieved to the surface and one or more valve inserts 44 are replaced, e.g., with a valve insert having the same cracking pressure or a different cracking pressure.

The systems and methods described herein provide various advantages over prior art techniques. For example, the bypass tool is a robust tool that can withstand the high temperature and pressure in a downhole environment and effectively regulate fluid flow and pressure without being damaged or worn out as in prior art bypass tools. Conventional bypass tools include a housing, ports and a spring to control fluid flow. However, such designs can pose problems during runs, such as erosion and flow cutting. The bypass tools described herein include modular and self-contained valve inserts configured so that they are positioned away from fluid flowing through the body and are less susceptible to wear and damage.

In addition, the bypass tool, in some embodiments, features a unitary or integral body which results in a tool that is stronger and more fatigue resistant than conventional tools. Further, the body is less complex and more cost-effective than other tools. The bypass tool is also very flexible and can be used in many different contexts, as valve inserts can be easily replaced to configure the tool for different uses that may require different flow properties.

In addition, configuring the bypass tool and/or replacing valve inserts is relatively simple. For example, if a valve becomes damaged or the tool is to be configured for a different purpose, the bypass tool can be retrieved to the surface and any valve insert can be easily replaced, e.g., by unscrewing the insert to be replaced and replacing it with a different insert. Operators at a rig site can maintain a supply of various inserts having different valves and/or different cracking pressures, so that the bypass tool can be quickly and easily repaired or reconfigured.

As discussed above, in one embodiment, the valve inserts are configured to operate purely by fluid pressure. Thus, no surface controls are needed (although active control mechanisms may be used if desired) as the valves in the valve inserts are automatically opened to divert fluid and regulate fluid flow.

The use of modular, replaceable valve inserts greatly simplifies the design and manufacture of downhole bypass tools, and allows for the use of replaceable valve insert modules. This allows for the possibility of redressing a bypass tool at a rigsite, which can allow a single tool to be much more productive.

Set forth below are some embodiments of the foregoing disclosure:

Embodiment 1

A fluid bypass apparatus including: an axially elongated body configured to be deployed in a borehole in an earth formation, the body including a pilot conduit that allows fluid to flow through the body and a bypass conduit extending from the pilot conduit to an exterior of the body and defining a fluid flow path from the primary conduit to the exterior of the body; and a modular valve insert housed within the bypass conduit, the valve insert being removable and replaceable, the modular valve insert configured to obstruct the fluid flow path and configured to automatically open in response to a pressure or flow rate through the primary conduit meeting or exceeding a selected threshold pressure or flow rate.

Embodiment 2

The apparatus as in any prior embodiment, wherein the pilot conduit has a first diameter at a first end of the body, a second diameter at a second end of the body, and a section having a third diameter that is less than the first diameter and the second diameter, the section acting as a flow restriction.

Embodiment 3

The apparatus as in any prior embodiment, wherein the modular valve insert is a self-contained unit having a housing and a valve assembly disposed in the housing, the housing including a connection mechanism configured to engage a respective connection mechanism at the body to removably attach the housing to the body within the bypass conduit.

Embodiment 4

The apparatus as in any prior embodiment, wherein the valve assembly includes a shuttle vale.

Embodiment 5

The apparatus as in any prior embodiment, wherein the pilot conduit includes a flow regulator configured to maintain flow therethrough at or below a selected flow rate or pressure.

Embodiment 6

The apparatus as in any prior embodiment, wherein the modular valve insert includes a pressure relief valve.

Embodiment 7

The apparatus as in any prior embodiment, wherein the modular valve insert is a plurality of modular valve inserts arrayed circumferentially around the primary conduit.

Embodiment 8

The apparatus as in any prior embodiment, wherein at least one of the plurality of valve inserts has a first cracking pressure and another of the plurality of valve inserts has a second cracking pressure that is different from the first cracking pressure.

Embodiment 9

The apparatus as in any prior embodiment, wherein the body is a unitary body having no moving parts.

Embodiment 10

The apparatus as in any prior embodiment, wherein the body includes a wall formed between the pilot conduit and the exterior of the body, and the bypass conduit includes a bore formed within the wall.

Embodiment 11

A method of controlling fluid flow in a borehole, the method including: deploying a borehole string in the borehole, the borehole string including a bypass apparatus having an axially elongated body, the body including a pilot conduit that allows fluid to flow through the body, and a bypass conduit extending from the pilot conduit to an exterior of the body and defining a fluid flow path from the primary conduit to an exterior of the body, the bypass apparatus including a modular valve insert housed within the bypass conduit, the modular valve insert being removable and replaceable, the modular valve insert configured to be closed to obstruct the fluid flow path when a pressure or flow rate through the pilot conduit is below a threshold pressure or flow rate value; and based on the pressure or flow rate meeting or exceeding the threshold pressure or flow rate, automatically opening the valve insert and permitting fluid to flow from the pilot conduit to the exterior to reduce the pressure or flow rate.

Embodiment 12

The method as in any prior embodiment, wherein the pilot conduit has a first diameter at a first end of the body, a second diameter at a second end of the body, and a section having a third diameter that is less than the first diameter and the second diameter, the section acting as a flow restriction.

Embodiment 13

The method as in any prior embodiment, further including inserting the modular valve insert as a self-contained unit into the bypass conduit, the modular valve insert having a housing and a valve assembly disposed in the housing.

Embodiment 14

The method as in any prior embodiment, wherein inserting the modular valve insert includes removably engaging a connection mechanism at the housing with a respective connection mechanism at the body to removably attach the housing to the body within the bypass conduit.

Embodiment 15

The method as in any prior embodiment, wherein the modular valve insert includes a shuttle valve.

Embodiment 16

The method as in any prior embodiment, wherein the pilot conduit includes a flow regulator configured to maintain flow through the body at or below a selected flow rate or pressure.

Embodiment 17

The method as in any prior embodiment, wherein the valve assembly includes a pressure relief valve.

Embodiment 18

The method as in any prior embodiment, wherein the modular valve insert is a plurality of valve inserts arrayed circumferentially around the primary conduit.

Embodiment 19

The method as in any prior embodiment, wherein at least one of the plurality of valve inserts has a first cracking pressure and another of the plurality of valve inserts has a second cracking pressure that is different from the first cracking pressure.

Embodiment 20

The method as in any prior embodiment, further including automatically opening the at least one of the plurality of valve inserts based on the pressure or flow rate through the pilot conduit causing a differential pressure in the at least one of the plurality of valve inserts meeting or exceeding a first threshold value, and automatically opening the another of the plurality of valve inserts based on the pressure or flow rate through the pilot conduit causing a differential pressure in the at least one of the plurality of valve inserts meeting or exceeding a second threshold value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A fluid bypass apparatus comprising:

an axially elongated body configured to be deployed in a borehole in an earth formation, the body being a unitary body that defines an internal pilot conduit that allows fluid to flow through the body and a plurality of bypass conduits extending from the pilot conduit to an exterior of the body and defining fluid flow paths from the pilot conduit to the exterior of the body, wherein the pilot conduit has a first diameter at a first end of the body, a second diameter at a second end of the body, and a section having a third diameter that is less than the first diameter and the second diameter, the section acting as a flow restriction, wherein the bypass apparatus is configured to control a property of fluid entering a mud motor disposed in the borehole, and the axially elongated body is configured to be deployed in the borehole at a location that is separate from a location of the mud motor; and a plurality of modular valve inserts housed within the plurality of bypass conduits and arrayed circumferentially around the primary conduit, each modular valve insert of the plurality of valve inserts being removable and replaceable, each modular valve insert configured to obstruct the fluid flow path and configured to automatically open in response to a pressure or flow rate through the primary conduit meeting or exceeding a selected threshold pressure or flow rate.

2. The apparatus of claim 1, wherein each of the plurality of modular valve inserts is a self-contained unit having a housing and a valve assembly disposed in the housing, the housing including a connection mechanism configured to engage a respective connection mechanism at the body to removably attach the housing to the body within the bypass conduit.

3. The apparatus of claim 2, wherein the valve assembly includes a shuttle valve.

4. The apparatus of claim 1, wherein each of the modular valve inserts includes a pressure relief valve.

5. The apparatus of claim 1, wherein at least one of the plurality of valve inserts has a first cracking pressure and another of the plurality of valve inserts has a second cracking pressure that is different from the first cracking pressure.

6. The apparatus of claim 1, wherein the body is a unitary body having no moving parts.

7. The apparatus of claim 1, wherein the body includes a wall formed between the pilot conduit and the exterior of the body, and the plurality of bypass conduits includes a plurality of bores formed within the wall.

8. A method of controlling fluid flow in a borehole, the method comprising:

deploying a borehole string in the borehole, the borehole string including a bypass apparatus having an axially elongated body, the body being a unitary body that defines an internal pilot conduit that allows fluid to flow through the body, the pilot conduit having a first diameter at a first end of the body, a second diameter at a second end of the body, and a section having a third diameter that is less than the first diameter and the second diameter, the section acting as a flow restriction, the body including a plurality of bypass conduits extending from the pilot conduit to an exterior of the body and defining fluid flow paths from the primary conduit to an exterior of the body, the bypass apparatus including a plurality of modular valve inserts housed within the plurality of bypass conduits, and arrayed circumferentially around the primary conduit, each modular valve insert being removable and replaceable, each modular valve insert configured to be closed to obstruct the fluid flow path when a pressure or flow rate through the pilot conduit is below a threshold pressure or flow rate value, wherein the bypass apparatus is configured to control a property of fluid entering a mud motor disposed in the borehole, and the axially elongated body is deployed in the borehole at a location that is separate from a location of the mud motor; and based on the pressure or flow rate meeting or exceeding the threshold pressure or flow rate, automatically opening at least one of the plurality of modular valve inserts and permitting fluid to flow from the pilot conduit to the exterior to reduce the pressure or flow rate.

9. The method of claim 8, further comprising inserting each modular valve insert as a self-contained unit into a respective bypass conduit, each modular valve insert having a housing and a valve assembly disposed in the housing.

10. The method of claim 9, wherein inserting each modular valve insert includes removably engaging a connection mechanism at the housing with a respective connection mechanism at the body to removably attach the housing to the body within the bypass conduit.

11. The method of claim 9, wherein at least one modular valve insert includes a shuttle valve.

12. The method of claim 8, wherein the valve assembly includes a pressure relief valve.

13. The method of claim 8, wherein at least one of the plurality of valve inserts has a first cracking pressure and another of the plurality of valve inserts has a second cracking pressure that is different from the first cracking pressure.

14. The method of claim 13, further comprising automatically opening the at least one of the plurality of valve inserts based on the pressure or flow rate through the pilot conduit causing a differential pressure in the at least one of the plurality of valve inserts meeting or exceeding a first threshold value, and automatically opening the another of the plurality of valve inserts based on the pressure or flow rate through the pilot conduit causing a differential pressure in the at least one of the plurality of valve inserts meeting or exceeding a second threshold value.

15. A fluid bypass apparatus comprising:

an axially elongated body configured to be deployed in a borehole in an earth formation, the body being a unitary body that defines an internal pilot conduit that allows fluid to flow through the body and a plurality of bypass conduits extending from the pilot conduit to an exterior of the body and defining fluid flow paths from the pilot conduit to the exterior of the body, wherein the pilot conduit has a first diameter at a first end of the body, a second diameter at a second end of the body, and a section having a third diameter that is less than the first diameter and the second diameter, the section acting as a flow restriction, wherein the bypass apparatus is configured to control a property of fluid entering a mud motor disposed in the borehole, and the axially elongated body is configured to be deployed in the borehole at a location that is separate from a location of the mud motor; and a plurality of modular valve inserts housed within the plurality of bypass conduits and arrayed circumferentially around the primary conduit, each modular valve insert of the plurality of valve inserts being removable and replaceable, each modular valve insert configured to obstruct the fluid flow path and configured to automatically open in response to a pressure or flow rate through the primary conduit meeting or exceeding a selected threshold pressure or flow rate.

* * * * *